US005617190A

United States Patent [19]

Takenaka et al.

[11] Patent Number: 5,617,190

[45] Date of Patent: Apr. 1, 1997

[54] DEVELOPING DEVICE FOR AN IMAGE FORMING APPARATUS WHICH REDUCES TONER CONSUMPTION AND WASTE

[75] Inventors: Eiji Takenaka; Mugijiroh Uno, both of Isehara, Japan

[73] Assignee: Ricoh Company, Ltd., Tokyo, Japan

[21] Appl. No.: 325,124

[22] Filed: Oct. 18, 1994

[30] Foreign Application Priority Data

Oct. 18, 1993 [JP] Japan ..... 5-259934

[51] Int. Cl.[6] ..... G03G 15/08

[52] U.S. Cl. ..... 399/159; 399/285

[58] Field of Search ..... 355/246, 259, 355/261, 265

[56] References Cited

U.S. PATENT DOCUMENTS 4,847,657 7/1989 Hanada et al. ..... 355/265 X 5,170,213 12/1992 Yamaguchi et al. ..... 355/246

5,179,411 1/1993 Yoshiuchi et al. ..... 355/246 X 5,477,006 12/1995 Imamiya et al. ..... 355/261 X

*Primary Examiner*—Fred L. Braun

*Attorney, Agent, or Firm*—Oblon, Spivak, McClelland, Maier & Neustadt, P.C.

[57] ABSTRACT

In an image forming apparatus, a developing device has an intermediate developing roller or belt between a developing roller and a photoconductive element. A high-tension power source applies a bias to the intermediate developing roller or belt. The bias before the start of printing is preselected to be zero volts, a voltage opposite in polarity to a charge potential deposited on the photoconductive element, or a voltage identical in polarity with the charge potential and smaller in an absolute value of potential than a potential deposited on the photoconductive element after exposure.

12 Claims, 6 Drawing Sheets

DEVELOPING DEVICE FOR AN IMAGE FORMING APPARATUS WHICH REDUCES TONER CONSUMPTION AND WASTE

BACKGROUND OF THE INVENTION

The present invention relates to a developing device for use in an electrophotographic image forming apparatus.

Developing devices applicable to a copier, facsimile apparatus, laser printer or similar image forming apparatus include one having a developing roller for depositing a toner fed by a toner supply roller on a photoconductive element, and an intermediate developing member interposed between the developing roller and the photoconductive element. The intermediate developing member is implemented as a belt or a roller. In a laser printer, for example, using this type of developing device, the portion of the photoconductive element extending between a charger and the developing device is not charged at the beginning of a printing operation for the first sheet. As a result, a toner deposits on the undesired portion of the photoconductive element to form a black solid smear.

With an image forming apparatus of the type having a semiconductor laser in optics thereof, it has been customary to effect output control, generally referred to as APC, in order to prevent the output of the laser from changing with a change in the temperature of the semiconductor. Specifically, the laser is caused to emit a beam during the interval between consecutive pages. The output of the laser is fed back to control a current to flow through the laser. This brings about a problem that the photoconductive element is exposed during the interval between pages, also causing the toner to deposit thereon in a black solid smear.

In any case, the toner deposited on the unexpected portion of the photoconductive element aggravates toner consumption. Moreover, since most of this part of the toner is collected by a cleaning unit, it increases the amount of waste toner. In addition, such toner is apt to be scattered around in the image forming apparatus.

SUMMARY OF THE INVENTION

It is, therefore, an object of the present invention to provide a developing device for an image forming apparatus which reduces toner consumption and waste toner and prevents toner from being scattered around in the apparatus.

In accordance with the present invention, a developing device for an image forming apparatus including a photoconductive element has a first conveying member for conveying a toner having high electric resistance and charged by friction or by charge injection, a second conveying member for receiving the toner from the first conveying member and developing an electrostatic latent image formed on the photoconductive element with the toner, and a bias source for applying a bias to the second conveying member. the second conveying member is, before a start of printing, zero volts, a voltage opposite in polarity to a charge potential deposited on the photoconductive element, or a voltage identical in polarity with the charge potential and smaller in an absolute value of potential than a potential deposited on the photoconductive element after exposure.

Also, in accordance with the present invention, a developing device for an image forming apparatus including a photoconductive element has a first conveying member for conveying a toner having high electric resistance and charged by friction or by charge injection, a second conveying member for receiving the toner from the first conveying member and developing an electrostatic latent image formed on the photoconductive element with the toner, and a bias source for applying a bias to the second conveying member. The bias to the second conveying member is, during the interval between consecutive pages, zero volts, a voltage opposite in polarity to a charge potential deposited on the photoconductive element, or a voltage identical in polarity with the charge potential and smaller in an absolute value of potential than a potential deposited on the photoconductive element after exposure.

Further, in accordance with the present invention, a developing device for an image forming apparatus including a photoconductive element has a first conveying member for conveying a toner having high electric resistance and charged by friction or by charge injection, a second conveying member for receiving the toner from the first conveying member and developing an electrostatic latent image formed on the photoconductive element with the toner, and a bias source for applying a bias to the second conveying member. The bias to the second conveying member is, before the start of printing and during the interval between consecutive pages, zero volts, a voltage opposite in polarity to a charge potential deposited on the photoconductive element, or a voltage identical in polarity with the charge potential and smaller in an absolute value of potential than a potential deposited on the photoconductive element after exposure.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
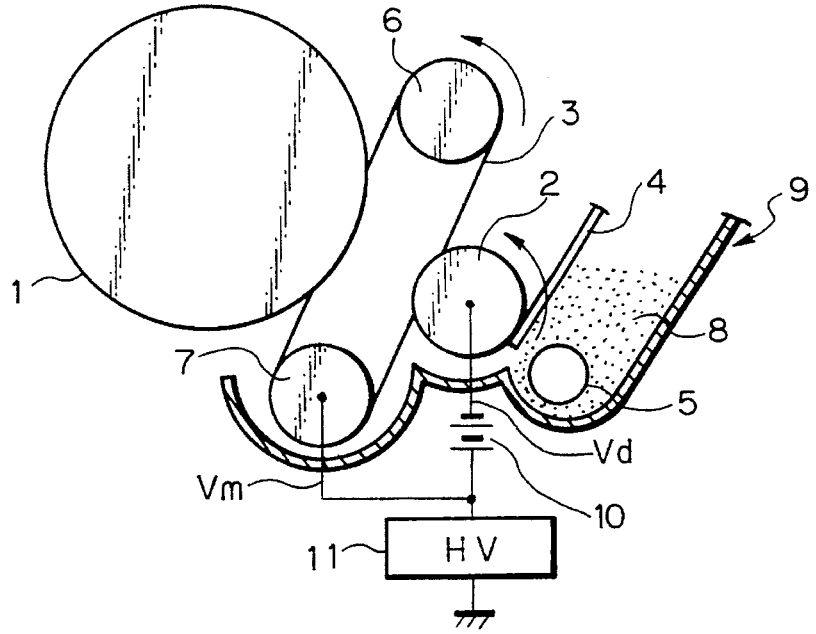
Fig. 1 PRIOR ART
FIG. 1 is a section showing a conventional developing device using an intermediate developing member in the form of a belt.

To better understand the present invention, a brief reference will be made to a conventional developing device using an intermediate developing member implemented as a belt, shown in FIG. 1. As shown, the developing device has a developing unit 9 located to face a photoconductive element implemented as a drum 1. The drum 1 is rotated while carrying an electrostatic latent image thereon. The developing unit 9 has a developing roller 2, a blade 4, a toner supply roller 5, an intermediate developing belt 3, and rollers 6 and 7. The developing roller, or first conveying means, 2 conveys a toner or magnetic one-component type developer 8. The blade 4 is held in contact with the developing roller 2 at the edge thereof. The toner supply roller 5 supplies the toner 8 to the developing roller 2. The intermediate developing belt, or second conveying means, 3 also conveys the toner 8. The belt 3 is passed over and driven by the rollers 6 and 7. A power source 10 is connected to the developing roller 2 and applies a bias voltage Vd (V) thereto. Also, a power source 11 applies a bias voltage Vm (V) to the developing belt 3.

Figure 2:
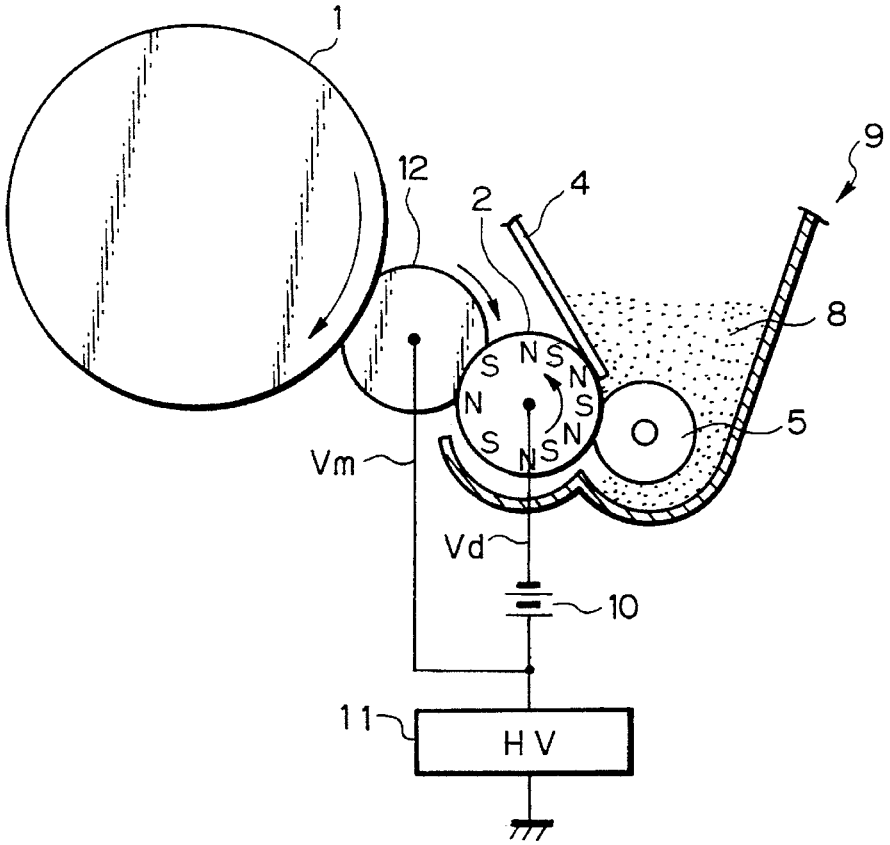
Fig. 2 PRIOR ART
FIG. 2 is a section of another conventional developing device using an intermediate developing member implemented as a roller.

FIG. 2 shows another conventional developing device. As shown, the developing device is essentially similar to the developing device of FIG. 1 except that it has an intermediate developing roller 12 in place of the belt 3. The toner 8 fed to the developing roller 2 by the toner supply roller 5 is magnetically deposited on the roller 2. While the developing roller 2 is rotated in a direction indicated by an arrow in the figure, the toner 8 is regulated by the blade 4 to form a thin toner layer on the roller 2. At the same time, the toner 8 is frictionally charged by the blade 4. The charged toner 8 is electrostatically transferred from the developing roller 2 to the intermediate developing roller 12. This roller 12 conveys the toner 8 to a position where the latent image on the drum 1 is to be developed. At this position, the toner 8 is selectively transferred from the roller 12 to the drum 1 on the basis of a relation between a bias being applied to the roller 12 and the surface potential of the drum 1. For example, assume that the toner is negatively chargeable, and that negative-to-positive development is effected. Then, the toner 8 develops the portions of the drum 1 where {(drum potential)–(roller bias)} is positive.

The conventional developing devices described above have some problems as discussed earlier. Specifically, in a laser printer, for example, the portion of the drum 1 extending between a charger, not shown, and the developing unit 9 is not charged at the beginning of a printing operation for the first sheet. As a result, the toner 8 deposits on the undesired portion of the drum 1 to form a black solid smear. With an image forming apparatus of the type having a semiconductor laser in optics thereof, it has been customary to effect output control, generally referred to as APC, in order to prevent the output of the laser from changing with a change in the temperature of the semiconductor. Specifically, the laser is caused to emit a beam during the interval between consecutive pages. The output of the laser is fed back to control a current to flow through the laser. This brings about a problem that the drum 1 is exposed during the interval between pages, also causing the toner to deposit thereon in a black solid smear.

In any case, the toner deposited on the unexpected portion of the drum 1 aggravates toner consumption. Moreover, since most of this part of the toner is collected by a cleaning unit, not shown, it increases the amount of waste toner. In addition, such toner is apt to be scattered around in the image forming apparatus.

Figure 3:
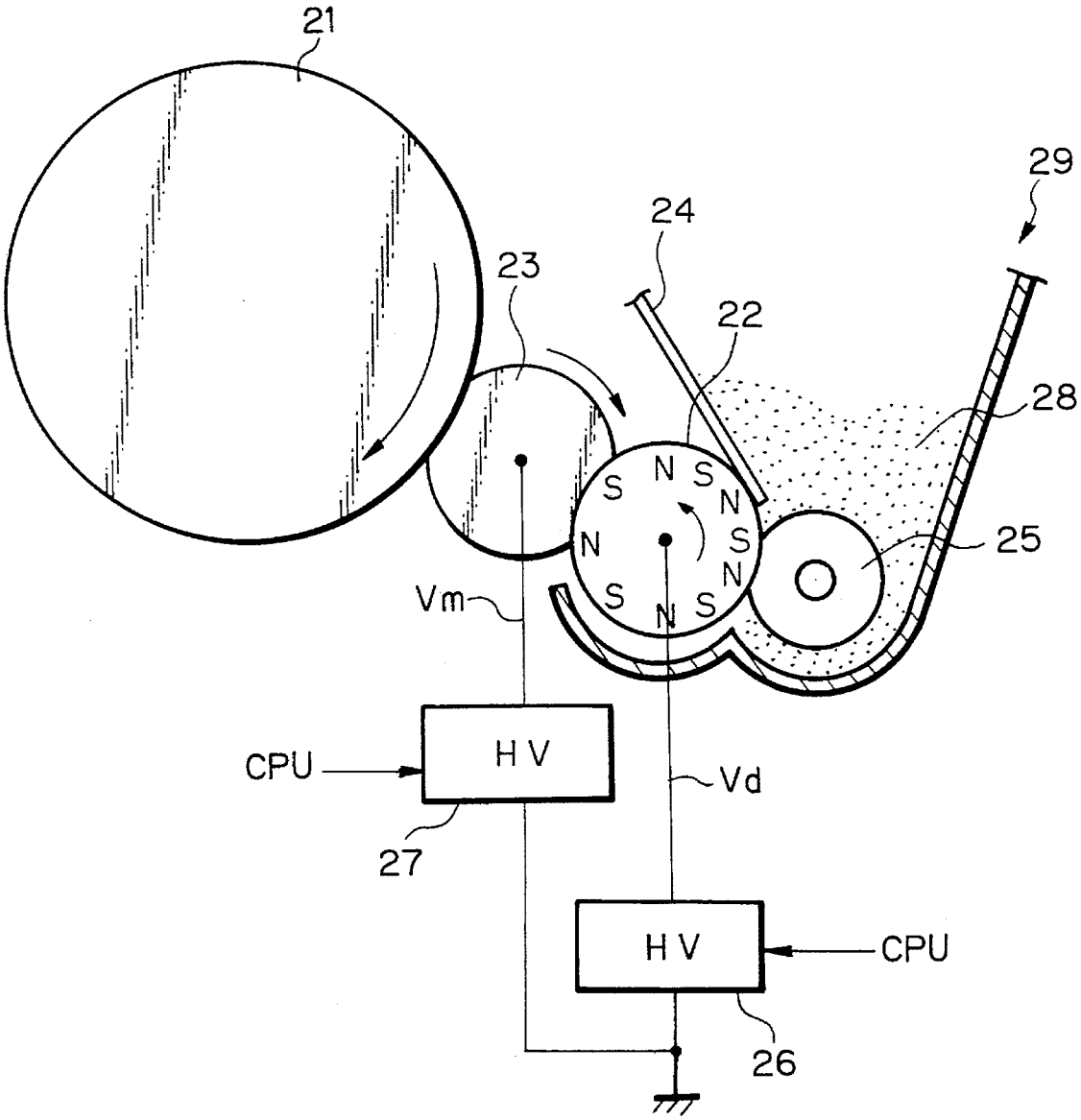
FIG. 3 is a section showing a developing device embodying the present invention.

Referring to FIG. 3, a developing device embodying the present invention is shown and includes a developing unit 29. The unit 29 is located to face a photoconductive drum 21 which is rotated while carrying an electrostatic latent image thereon. The unit 29 should only be loaded with a one-component type developer, i.e., magnetic toner having high electric resistance. In the illustrative embodiment, a developing roller 22, a blade 24 and a toner supply roller 25 are accommodated in the unit 29. The developing roller, or first conveying means, 22 has magnetic poles on the surface thereof. The blade 24 is held in contact with the developing roller 22 at the edge thereof. The toner supply roller 25 feeds the toner 28 to the developing roller 22. An elastic intermediate developing roller, or second conveying means, 23 is interposed between the developing roller 22 and the drum 21. The roller 23 is held in contact with each of the drum 21 and roller 22 over a predetermined nip dimension due to the elasticity thereof.

A first high-tension power source (HV) 26 applies a bias Vd (V) for toner transfer to the developing roller 22. A second high-tension power source (HV) 27 applies a bias Vm (V) for toner transfer to the intermediate developing roller 23. The biases Vd and Vm of the power sources 26 and 27, respectively, can be switched over by signals from a CPU (Central Processing Unit), not shown, which controls the developing unit 29.

The operation of the embodiment will be described hereinafter. It is to be noted that the directions in which the rollers included in the embodiment are rotated are only illustrative. The toner 28 fed to the developing roller 22 by the toner supply roller 25 is magnetically deposited on the roller 22. As the developing roller 22, carrying the toner 28 thereon, rotates in a direction indicated by an arrow in the figure, the toner 28 is leveled by the blade 24 to form a thin layer while being frictionally charged by the blade 24. The charged toner 28 is electrostatically transferred from the developing roller 22 to the intermediate developing roller 23. This roller 23 conveys the toner 28 to a position for developing a latent image formed on the drum 21, i.e., a developing position. At the developing position, the toner 28 develops the latent image on the basis of a potential difference between the roller 23 and the drum 21.

Figure 4:
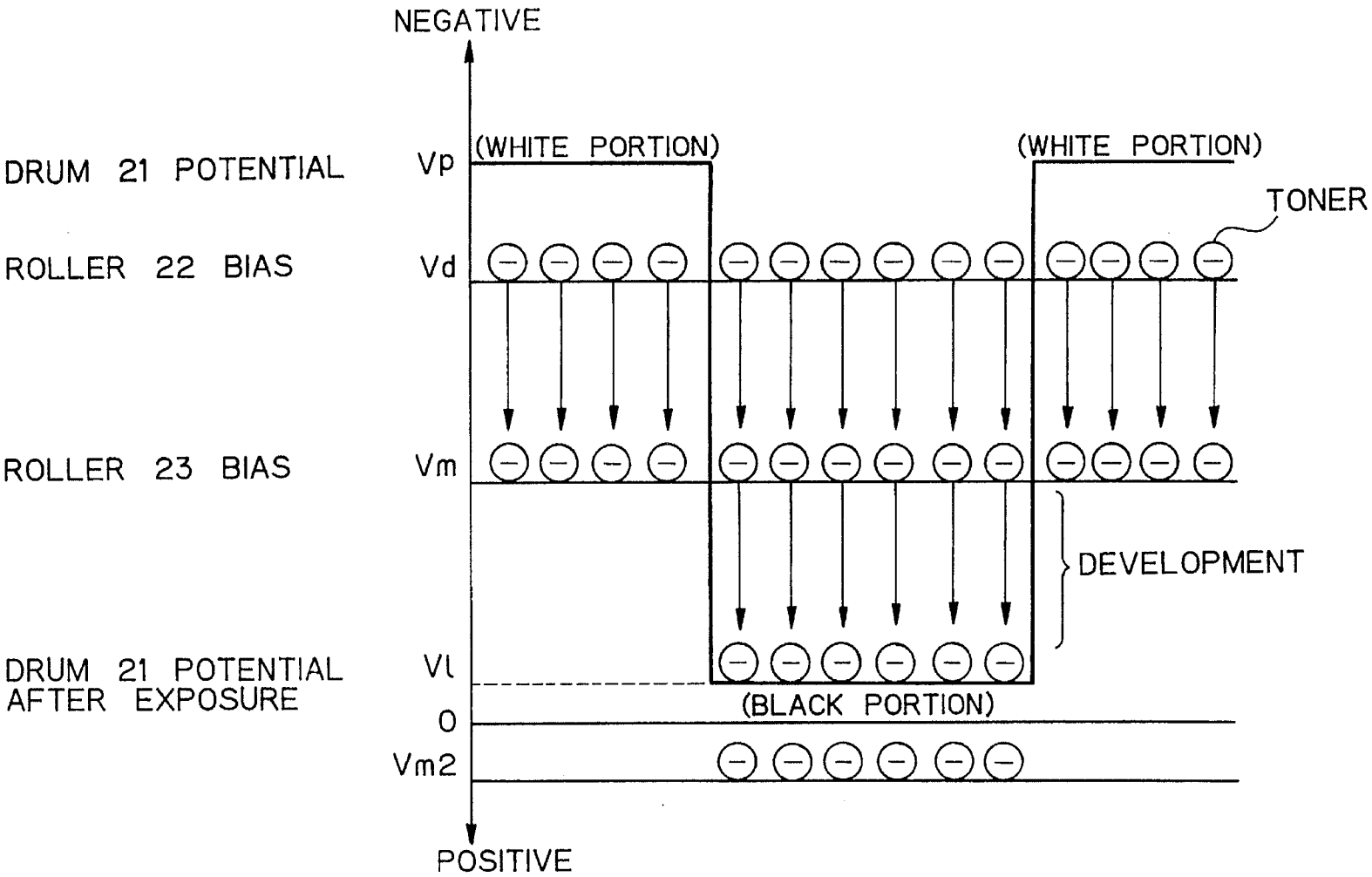
FIG. 4 illustrates a relation between potentials to deposit on various members included in the embodiment.

As illustrated in FIG. 4, the bias Vd to the developing roller 22 and the bias Vm to the intermediate developing roller 23 are preselected such that $Vm-Vd>0$ holds. Hence, the negatively charged toner is transferred from the roller 22 to the roller 23. Further, assuming that the charge potential of the drum 21 is Vp and the potential thereof after exposure is Vl (V), the bias Vm is predetermined such that $Vp<Vm<Vl$ ($<0$) holds. In this condition, the toner 28 deposits on the black portions of an image, but not on the white portions of the same. Conversely, if the relation is $Vp<Vl<Vm$, the toner 28 will not deposit even on the portions of the drum 28 where the potential is Vl (V) either.

Figure 5:
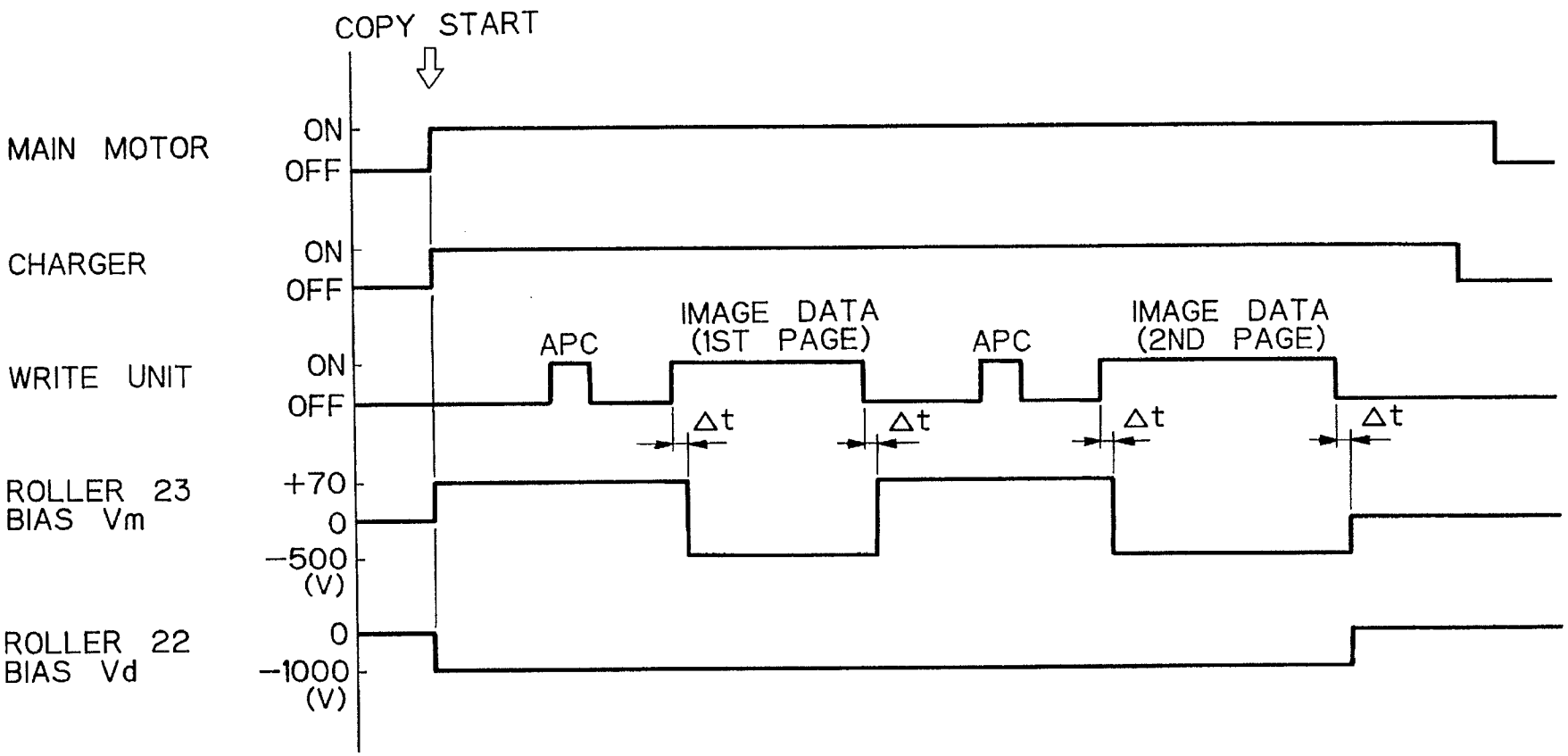
FIG. 5 is a timing chart representing a relation between various loads included in the embodiment and biases.

FIG. 5 is a timing chart representing a relation between a main motor which drives the drum 21 and developing unit 29, a charger, an optical writing unit (semiconductor laser), and the biases Vd and Vm. As shown, on the start of a copying operation, the main motor and charger are turned on at the same time. At this instant, +70 V and −1000 V are respectively applied to the rollers 23 and 22 as the biases Vm and Vd. The writing unit starts writing image data representative of the first page on the drum 21 after the previously stated APC. On the elapse of a period of time $\Delta t$ since the beginning of the data writing, the bias Vm to the roller 23 is switched from +70 V to −500 V. It is to be noted that the period of time $\Delta t$ is simply derived from the distance between the optical writing position and the developing position.

The APC control is also effected between the first page and the second page. During the interval between the consecutive pages, the bias Vm to the roller 23 is switched from −500 V to +70 V. After the writing device has started writing image data representative of the second page, the bias Vm is again switched from +70 V to −500 V on the elapse of the period of time Δt. By so switching over the bias Vm to the roller 23, it is possible to prevent the toner 28 from depositing on the unexposed portion of the drum 21.

Figure 6:
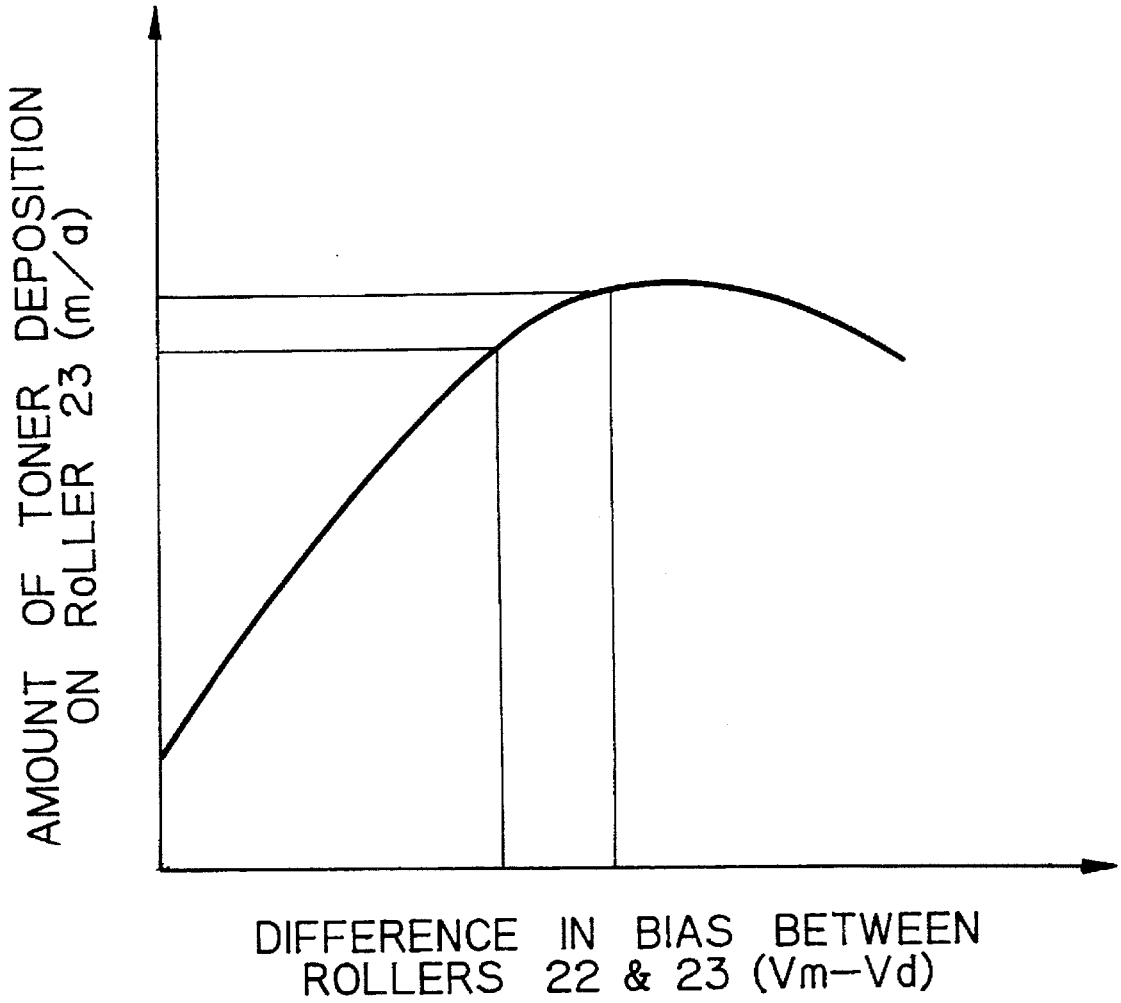
FIG. 6 is a graph indicative of a relation between a difference between biases applied to a developing roller and intermediate developing roller and the amount of toner deposition on the intermediate developing roller.

FIG. 6 is a graph indicative of a relation between the difference between the biases Vm and Vd, i.e., (Vm–Vd) and the amount of toner (m/a) to deposit on the intermediate developing roller 23. As shown, the amount of toner deposition m/a on the roller 23 increases with an increase in the difference (Vm–Vd). However, when the difference (Vm–Vd) increases beyond a certain value, the amount m/a decreases. In this manner, the difference (Vm–Vd) and the amount of toner deposition on the roller 23 have an essential correlation.

The amount of toner deposition m/a on the intermediate developing roller 23 has critical influence on the density of an image transferred to a sheet. Hence, the amount m/a changes with a change in the bias Vm to the roller 23. As a result, the image density on a sheet changes, resulting in an irregular density distribution. Hereinafter will be described an implementation for obviating this occurrence while eliminating the above-discussed needles toner deposition.

Figure 7:
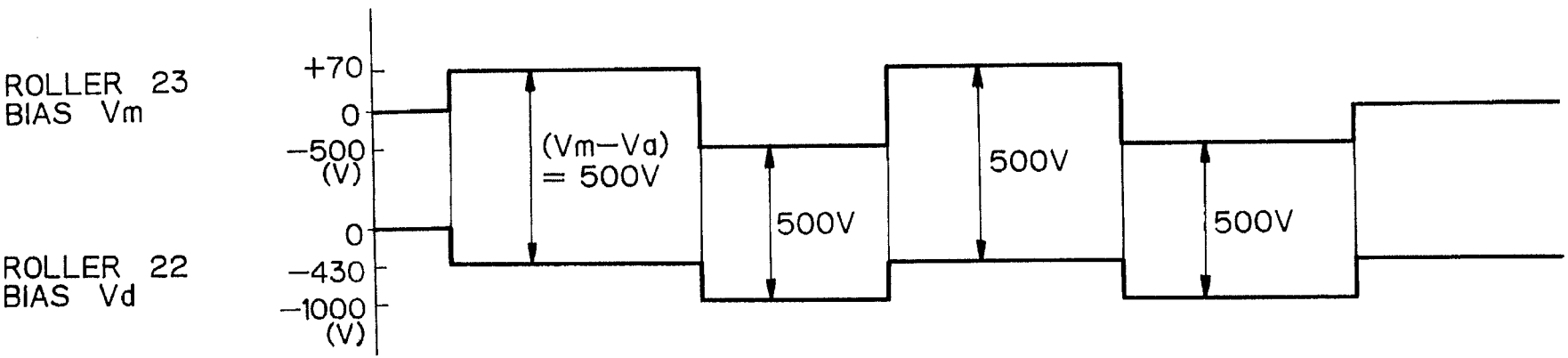
FIG. 7 is a timing chart representing an implementation for preventing the amount of toner deposition from changing.

As shown in FIG. 7, while the bias Vm to the intermediate developing roller 23 is switched over as in FIG. 5, the bias Vd to the developing roller 22 is also switched over such that the difference (Vm–Vd) remains constant. This successfully prevents the amount of toner deposition m/a on the roller 23 from changing despite the switchover of the bias Vm.

The advantages of the embodiment described above are also achievable even when the intermediate developing roller 23 is replaced with the intermediate developing belt 3 shown in FIG. 1.

In summary, it will be seen that the present invention provides a developing device which obviates the needless deposition of toner on a photoconductive element so as to reduce toner consumption and waste toner and to prevent the toner from being scattered around in an image forming apparatus.

Various modifications will become possible for those skilled in the art after receiving the teachings of the present disclosure without departing from the scope thereof.

What is claimed is:

1. A developing device for an image forming apparatus having a photoconductive element, comprising:

first conveying means for conveying a toner having high electric resistance and charged by one of friction and charge injection;

second conveying means for receiving the toner from said first conveying means and developing an electrostatic latent image formed on the photoconductive element with said toner;

first bias applying means for applying a first bias to said second conveying means; and second bias applying means for applying a second bias to said first conveying means;

wherein said first and second biases applied to said first and second conveying means, respectively, are individually charged such that a first difference between said first and second biases before printing and a second difference between said first and second biases at a time of printing are equal to each other.

2. A developing device for an image forming apparatus having a photoconductive element, comprising:

first conveying means for conveying a toner having high electric resistance and charged by one of friction and charge injection;

second conveying means for receiving the toner from said first conveying means and developing an electrostatic latent image formed on the photoconductive element with said toner;

first bias applying means for applying a first bias to said second conveying means; and second bias applying means for applying a second bias to said first conveying means;

wherein said first and second biases applied to said first and second conveying means, respectively, are individually charged such that a first difference between said first and second biases before printing and a second difference between said first and second biases during an interval between consecutive pages are equal to each other.

3. A developing device for an image forming apparatus having a photoconductive element, comprising:

first conveying means for conveying a toner having high electric resistance and charged by one of friction and charge injection;

second conveying means for receiving the toner having said first conveying means and developing an electrostatic latent image formed on the photoconductive element with said toner;

first bias applying means for applying a first bias to said second conveying means; and second bias applying means for applying a second bias to said first conveying means;

wherein said first and second biases applied to said first and second conveying means, respectively, are individually charged such that a first difference between said first and second biases at a time of printing and a second difference between said first and second biases before printing and a third difference between said first and second biases during an interval between consecutive pages are equal to each other.

4. A developing device for an image forming apparatus having a photoconductive element, comprising:

first conveying means for conveying a toner having high electric resistance and charged by one of friction and charge injection;

second conveying means for receiving the toner from said first conveying means and developing an electrostatic latent image formed on the photoconductive element with said toner;

first bias applying means for applying a first bias to said second conveying means;

second bias applying means for applying a second bias to said first conveying means;

said first bias applied to said second conveying means being, before a start of printing, one of zero volts, a voltage opposite in polarity to a charge potential deposited on the photoconductive element, and a voltage identical in polarity with said charge potential and smaller in an absolute value of potential than a potential deposited on said photoconductive element after exposure; and wherein said first and second biases applied to said first and second conveying means, respectively, are individually charged such that a first difference between said first and second biases before printing and a second difference between said first and second biases at a time of printing are equal to each other.

5. A developing device as claimed in claim 4, wherein said second conveying means comprises a belt.

6. A developing device as claimed in claim 4, wherein said second conveying means comprises a roller.

7. A developing device for an image forming apparatus having a photoconductive element, comprising:

first conveying means for conveying a toner having high electric resistance and charged by one of friction and charge injection;

second conveying means for receiving the toner from said first conveying means and developing an electrostatic latent image formed on the photoconductive element with said toner;

first bias applying means for applying a first bias to said second conveying means;

second bias applying means for applying a second bias to said first conveying means;

said first bias applied to said second conveying means being, during an interval between consecutive pages, one of zero volts, a voltage opposite in polarity to a charge potential deposited on the photoconductive element, and a voltage identical in polarity with said charge potential and smaller in an absolute value of potential than a potential deposited on said photoconductive element after exposure; and wherein said first and second biases applied to said first and second conveying means, respectively, are individually charged such that a first difference between said first and second biases before printing and a second difference between said first and second biases during an interval between consecutive pages are equal to each other.

8. A developing device as claimed in claim 7, wherein said second conveying means comprises a belt.

9. A developing device as claimed in claim 7, wherein said second conveying means comprises a roller.

10. A developing device for an image forming apparatus having a photoconductive element, comprising:

first conveying means for conveying a toner having high electric resistance and charged by one of friction and charge injection;

second conveying means for receiving the toner from said first conveying means and developing an electrostatic latent image formed on the photoconductive element with said toner;

first bias applying means for applying a first bias to said second conveying means;

second bias applying means for applying a second bias to said first conveying means;

said first bias applied to said second conveying means being, before a start of printing and during an interval between consecutive pages, one of zero volts, a voltage opposite in polarity to a charge potential deposited on the photoconductive element, and a voltage identical in polarity with said charge potential and smaller in an absolute value of potential than a potential deposited on said photoconductive element after exposure; and wherein said first and second biases applied to said first and second conveying means, respectively, are individually charged such that a first difference between said first and second biases at a time of printing and a second difference between said first and second biases before printing and a third difference between said first and second biases during an interval between consecutive pages are equal to each other.

11. A developing device as claimed in claim 10, wherein said second conveying means comprises a belt.

12. A developing device as claimed in claim 10, wherein said second conveying means comprises a roller.

* * * * *